US007626551B2

(12) United States Patent
Chien et al.

(10) Patent No.: US 7,626,551 B2
(45) Date of Patent: Dec. 1, 2009

(54) MULTI-BAND PLANAR INVERTED-F ANTENNA

(75) Inventors: Chin-Cheng Chien, Daxl Town (TW); Chien-Hsien Ho, Taoyuan County (TW); Chien-Jung Lin, Kaohsiung (TW); Yu-Sheng Chang, Taoyuan County (TW)

(73) Assignee: Foxconn Communication Technology Corp., Taoyuan County (TW)

( * ) Notice: Subject to any disclaimer, the term of this patent is extended or adjusted under 35 U.S.C. 154(b) by 288 days.

(21) Appl. No.: 11/836,315

(22) Filed: Aug. 9, 2007

(65) Prior Publication Data

US 2009/0040110 A1 Feb. 12, 2009

(51) Int. Cl.
*H01Q 1/38* (2006.01)
*H01Q 13/10* (2006.01)

(52) U.S. Cl. ..... 343/700 MS; 343/702; 343/767; 343/770

(58) Field of Classification Search ..... 343/700 MS, 343/702, 767, 770
See application file for complete search history.

(56) References Cited

U.S. PATENT DOCUMENTS 6,806,834 B2 * 10/2004 Yoon ..... 343/702
6,819,287 B2 * 11/2004 Sullivan et al. ..... 343/700 MS

* cited by examiner

*Primary Examiner*—Hoang V Nguyen
(74) *Attorney, Agent, or Firm*—Steven M. Reiss

(57) ABSTRACT

A multi-band planar inverted-F antenna includes a radiating unit, a ground unit and a feeding unit. The radiating unit includes a common radiating element, a high-frequency (HF) radiating element and a low-frequency (LF) radiating element. A quasi U-shaped slot is defined between the HF radiating element and the LF radiating element. The ground unit is electrically connected to one side of the common radiating element. The feeding unit includes a strip electrically connected to one side of the HF radiating element. The ground unit includes a ground point and an inverted-L short-line connected to the ground point at one end thereof. The inverted-L short-line is also electrically connected to the common radiating element at another end thereof. A loop surface current induced by the inverted-L short-line can advantageously enhance bandwidth of the multi-band planar inverted-F antenna at frequencies of interest.

17 Claims, 7 Drawing Sheets

MULTI-BAND PLANAR INVERTED-F ANTENNA

BACKGROUND OF THE INVENTION

1. Field of the Invention

The present invention relates to a multi-band plane inverted-F antenna (PIFA), especially to a multi-band PIFA with an inverted-L short-line to induce a loop surface current, thus enhancing the bandwidth of the multi-band PIFA at multiple frequencies of interest.

2. Description of Prior Art

Modern electronic products for consumer have the trends of compact size and light weight, as manufacture technology and design skill progress. It is also desirable to integrate more versatile functions to the electronic products. Taking wireless communication devices as example, the networking accessing function through wireless application protocol (WAP) and e-mail function are augmented to the original voice function.

Moreover, smart phones with data processing ability and wireless LAN function are also attractive to user these years. The smart phones can provide advanced functions such as mobile TV and business transaction as the wireless bandwidth increases and the processing ability of mobile phone is enhanced. To this end, the antenna for mobile phone is also demanded to scale down for compact requirement.

The physical size of a microwave antenna, such as dipole antenna and microstrip patch, is around the half wavelength of the resonant modes of the antenna size. To further minimize the physical size of a microwave antenna, planar inverted-F antenna (PIFA) is developed to provide signal transmission/reception at quarter wavelength. Planar inverted-F antenna can also be realized as a hidden antenna for mobile phone due to the low profile property.

FIG. 1 shows the schematic diagram of a prior art planar inverted-F antenna. The planar inverted-F antenna 10*a* mainly comprises a radiating unit 12*a*, a ground plane 20*a*, a dielectric material (not shown), a shorting element 16*a* and a feeding element 14*a*. The dielectric material is sandwiched between the radiating unit 12*a* and the ground plane 20*a* to provide isolation therebetween. The radiating unit 12*a* is coupled to the ground plane 20*a* through the shorting element 16*a*. The feeding element 14*a* is arranged on the ground plane 20*a* and is coupled to the radiating unit 12*a* for signal transmission. The radiating unit 12*a* and the ground plane 20*a* can be implemented with metallic material. The radiating unit 12*a* is designed with specific pattern for achieving desired operating wavelength and radiation performance. The most attractive feature of planar inverted-F antenna is the ability to work at quarter wavelength for advantageously reducing the size of antenna.

However, the prior art planar inverted-F antenna has the drawbacks of insufficient bandwidth and inability to work at multiple frequencies (more than dual-band frequencies). The smart phone is expected to work at tri-bands or even qua-band mobile communication frequencies, and have accessing ability to WLAN. Therefore, it is important issue to provide a multi-band planar inverted-F antenna for mobile phones such as smart phones.

SUMMARY OF THE INVENTION

It is an object of the present invention to provide a multi-band plane inverted-F antenna (PIFA), which has broad-bandwidth at multiple operating frequencies.

Accordingly, the present invention provides a multi-band plane inverted-F antenna (PIFA), which includes a radiating unit, a ground unit and a feeding unit. The radiating unit includes a common radiating element, a high-frequency (HF) radiating element and a low-frequency (LF) radiating element. A quasi U-shaped slot is defined between the HF radiating element and the low-frequency LF radiating element. The ground unit is electrically connected to one side of the common radiating element. The feeding unit includes a strip electrically connected to one side of the HF radiating element. The ground unit includes a ground point and an inverted-L short-line connected to the ground point at one end thereof. The inverted-L short-line is also electrically connected to the common radiating element at another end thereof. A loop surface current induced by the inverted-L short-line can advantageously enhance bandwidth of the multi-band planar inverted-F antenna at frequencies of interest.

BRIEF DESCRIPTION OF DRAWING

The features of the invention believed to be novel are set forth with particularity in the appended claims. The invention itself however may be best understood by reference to the following detailed description of the invention, which describes certain exemplary embodiments of the invention, taken in conjunction with the accompanying drawings in which:

DETAILED DESCRIPTION OF THE INVENTION

Figure 1:
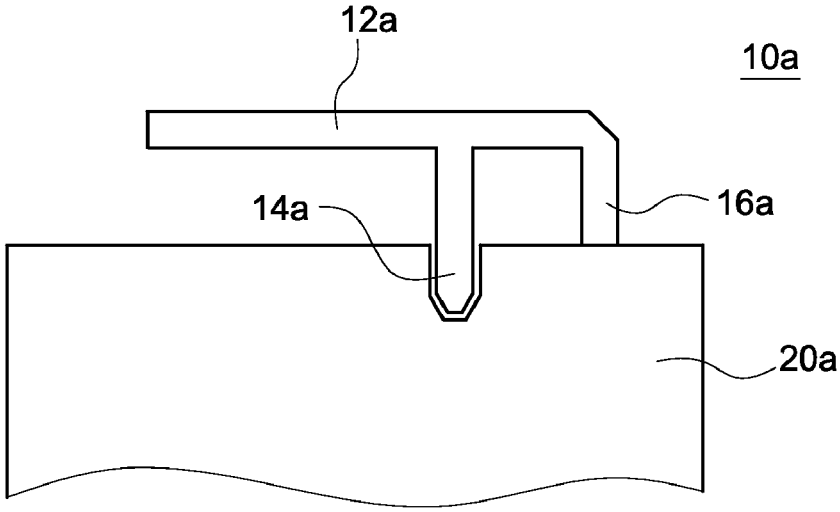
FIG.1 (Prior Art)
FIG. 1 shows the schematic diagram of a prior art planar inverted-F antenna.
Figure 2:
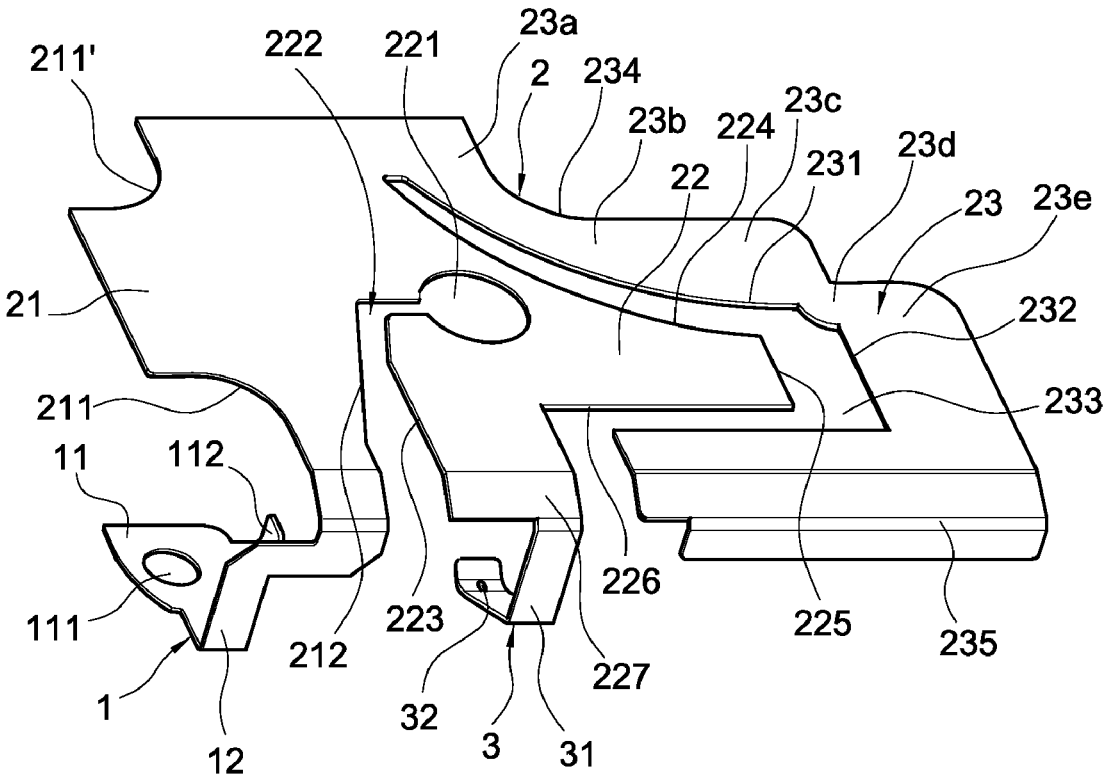
FIG. 2 shows the perspective view of the multi-band planar inverted-F antenna according to the present invention.

With reference to FIG. 2, the multi-band planar inverted-F antenna according to a preferred embodiment of the present invention comprises a ground unit 1, a radiating unit 2 and a feeding unit 3.

The ground unit 1 is of plate shape and comprises a ground point 11. A ground hole 111 is defined on the ground point 11 and is fixed to an electronic device (not shown) by a retaining element (not shown). Alternatively, the ground hole 111 is electrically connected to a ground terminal of an electronic device (not shown). A flange 112 is outwardly extended from one side of the ground point 11; and an inverted-L short-line 12 is extended from another end of the ground point 11. The inverted-L short-line 12 is preferably ⅛ resonant wavelength of the multi-band PIFA of the present invention and is electrically connected to the radiating unit 2.

The radiating unit 2 is of plate shape and comprises a common radiating element 21, a high-frequency (HF) radiating element 22 and a low-frequency (LF) radiating element 23, which are electrically connected together. Two dents 211 and 211' are defined on one side of the common radiating element 21. The ground unit 1 is electrically connected to the common radiating element 21 at a location near the dent 211 and with a bending angle, wherein the bending angle is substantially close to or equal to 90 degrees. A round through hole 221 is defined at a location where the common radiating element 21 is electrically connected with the HF radiating element 22. An L-shaped slot 22 is communicated with the round through hole 221 and is defined by a bottom side 223 of the HF radiating element 22 and a top side 212 of the common radiating element 21. The HF radiating element 22 comprises an arc-shaped lateral side 224, a parallel top side 225 and an L-shaped lateral side 226. The arc-shaped lateral side 224, the top side 225 and the L-shaped lateral side 226, as well as the bottom side 223 define the surface area of the HF radiating element 22.

A tab 227 is extended from the L-shaped lateral side 226 and the bottom side 223 of the HF radiating element 22. The LF radiating element 23 comprises an arc-shaped inner side 231 and an L-shaped inner side 232. A quasi U-shaped slot 233 is defined by the arc-shaped inner side 231, the L-shaped inner side 232, the arc-shaped lateral side 224, the top side 225 and the L-shaped lateral side 226. A stair-shaped section 234 is formed on the outer face of the LF radiating element 23. The stair-shaped section 234, the arc-shaped inner side 231 and the L-shaped inner side 232 define a first surface portion 23*a*, a second surface portion 23*b*, a third surface portion 23*c*, a fourth surface portion 23*d* and a fifth surface portion 23*e*. The second surface portion 23*b* and the fourth surface portion 23*d* have relatively narrower width than those of the first surface portion 23*a*, the third surface portion 23*c* and the fifth surface portion 23*e*. A bent panel 235 with continuous bending is extended from one side of the LF radiating element 23.

The feeding unit 3 comprises an L-shaped strip 31, which is connected to the tab 227 on one side of the HF radiating element 22. The feeding unit 3 is electrically connected to the HF radiating element 22 with a bending angle and the bending angle is substantially close to or equal to 90 degrees. A through hole 32 is defined at one end of the L-shaped strip 31 and soldered with a coaxial cable (not shown), which feeds signal into the antenna.

Figure 3:
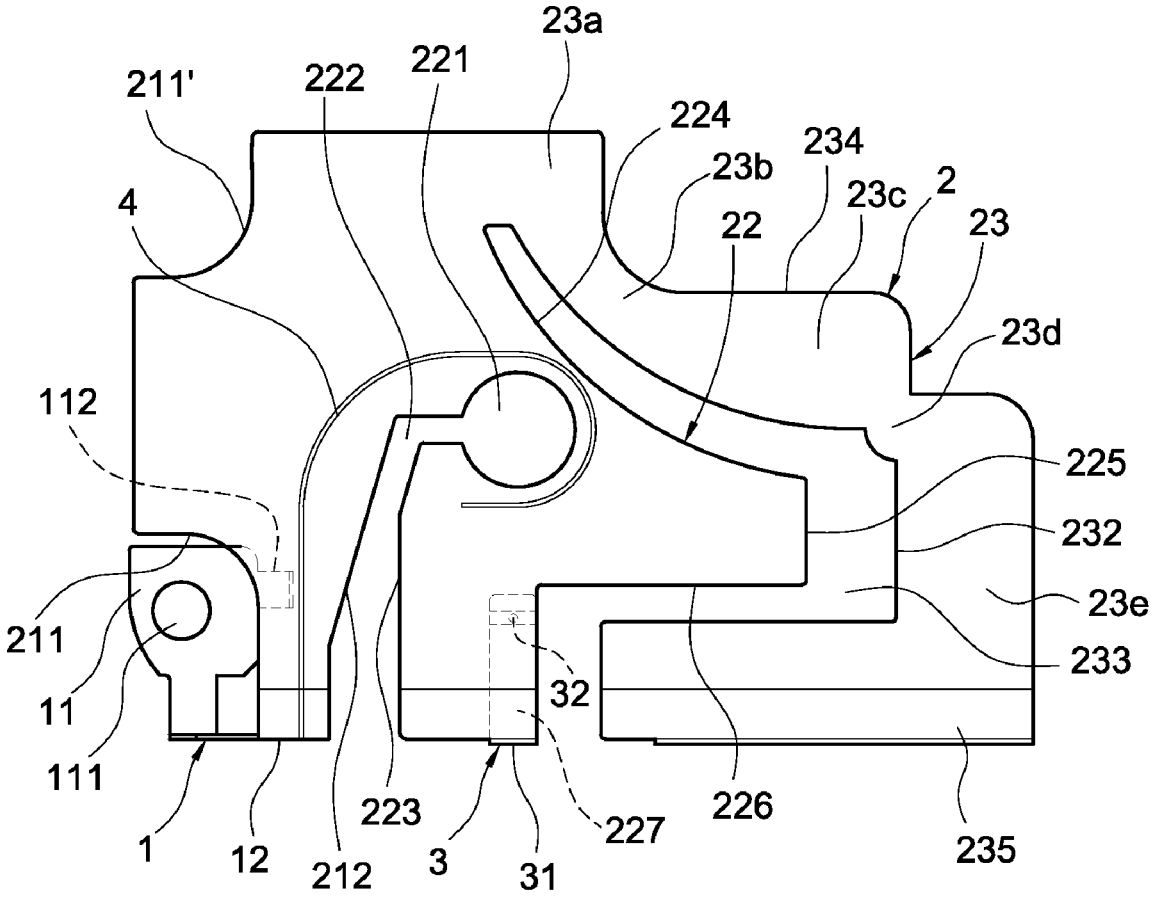
FIG. 3 shows the top view of the multi-band planar inverted-F antenna according to the present invention.
Figure 4:
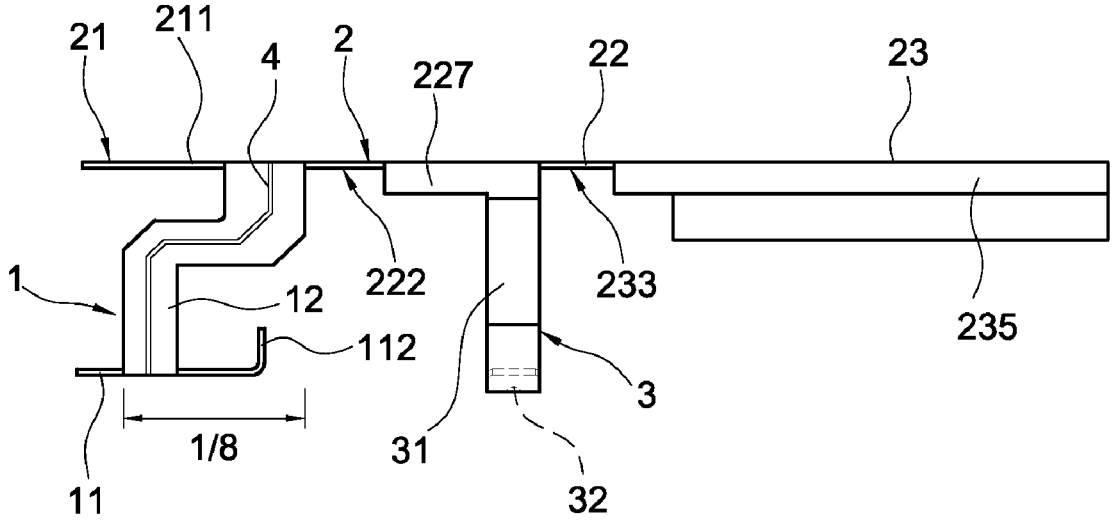
FIG. 4 shows the section view of the multi-band planar inverted-F antenna according to the present invention.

With reference to FIGS. 3 and 4, the sizes of the HF radiating element 22 and the LF radiating element 23 can be adjusted to match quarter-wavelength of a resonant mode of the antenna.

With reference again to FIG. 3, the second surface portion 23*b* and the fourth surface portion 23*d* are designed to have relatively narrower width than those of the first surface portion 23*a*, the third surface portion 23*c* and the fifth surface portion 23*e*. The antenna portion with wider cross section has larger current flowing there through, this will result in a good Q factor. However, the bandwidth of the antenna is influenced. Therefore, some antenna portions are provided with narrower width to enhance bandwidth of the antenna.

The length of the inverted-L short-line 12 is preferably ⅛ resonant wavelength of the multi-band PIFA of the present invention. The inverted-L short-line 12 is connected between the feed point 3 and the ground point 11. By the provision of the inverted-L short-line 12, a loop surface current 4 is induced around the peripheral of the round through hole 221 and the L-shaped slot 22. Therefore, the bandwidth of the multi-band PIFA of the present invention can be broadened. The multi-band PIFA of the present invention has broader bandwidth at multiple operation frequencies. The multi-band PIFA of the present invention can be advantageously employed for mobile communication devices (such as smart phones) requiring broader bandwidth at multiple frequencies.

Figure 5:
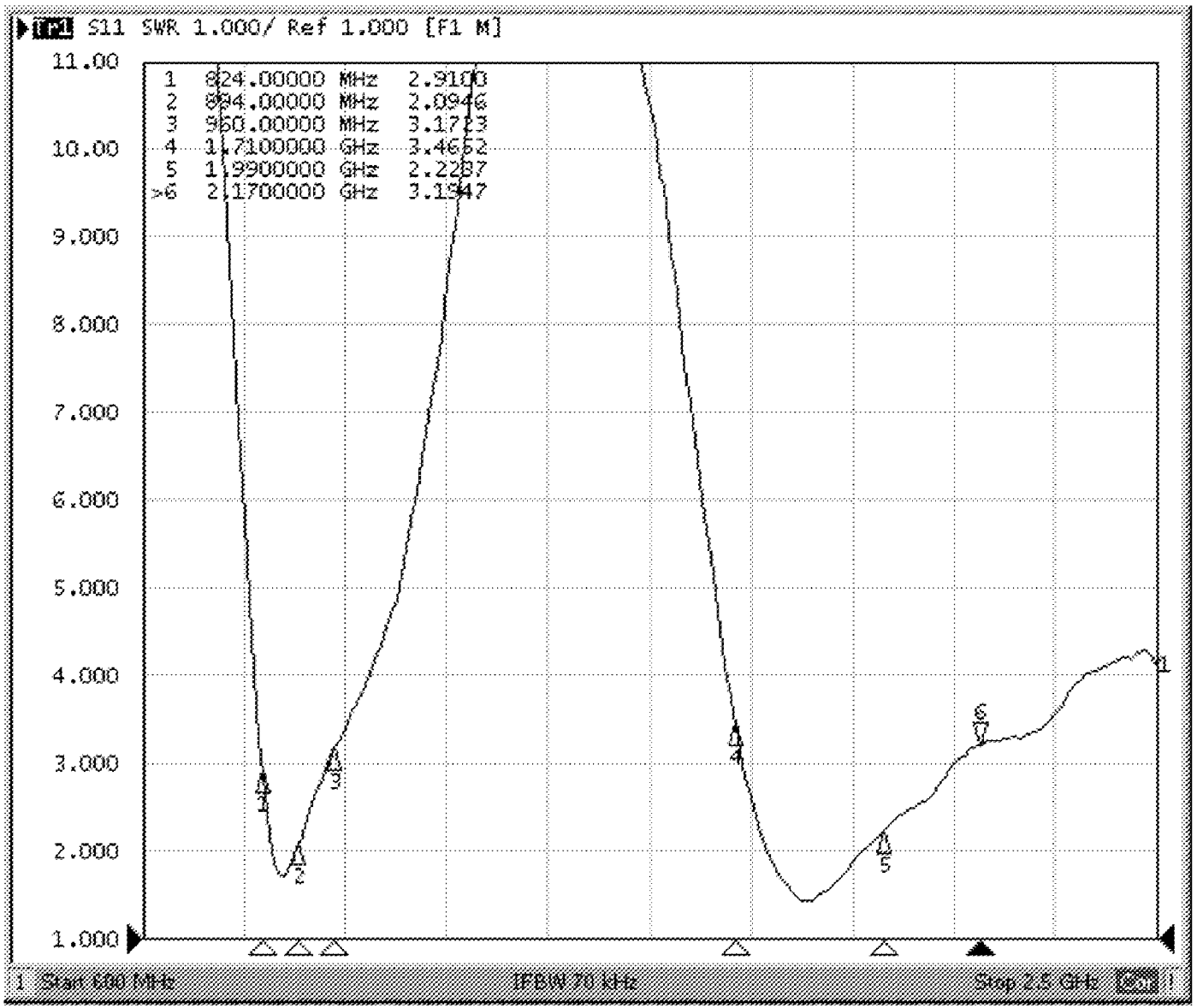
FIG. 5 shows the voltage standing wave ratio (VSWR) for the multi-band PIFA of the present invention.

FIG. 5 shows the voltage standing wave ratio (VSWR) for the multi-band PIFA of the present invention. The VSWR measurements of the multi-band PIFA of the present invention are 2.91, 2.09, 3.17, 3.46, 2.22 and 3.19 for operational frequencies of 824 MHz, 894 MHz, 960 MHz, 1710 MHz, 1990 MH and 2170 MHz, respectively. As can be seen from this figure, all the VSWR measurements of the multi-band PIFA of the present invention at frequencies of interest are below 3.5. This proves the multi-band PIFA of the present invention has excellent VSWR for multiple frequencies.

Figure 6:
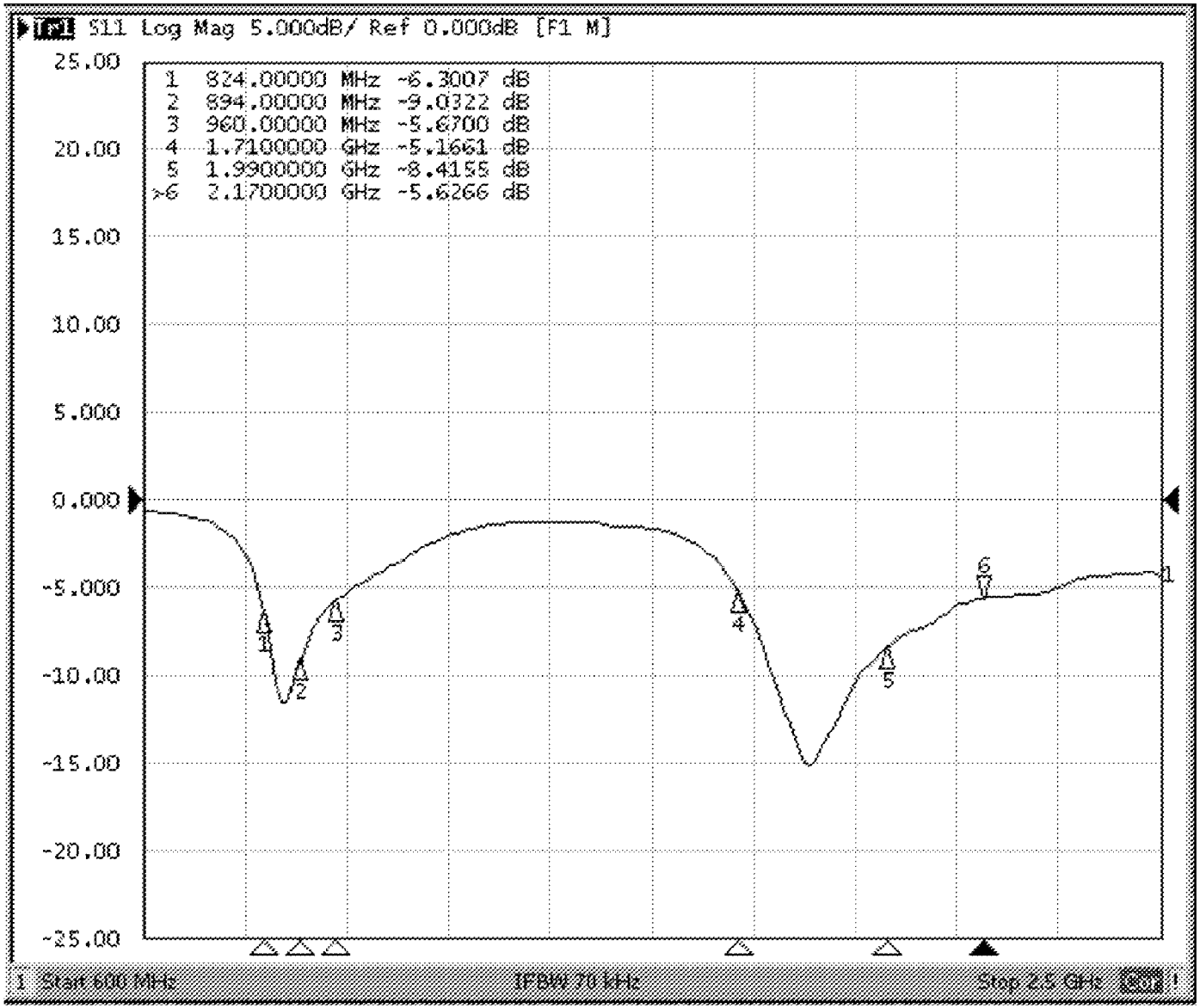
FIG. 6 shows the return loss measurement for the multi-band PIFA of the present invention.

FIG. 6 shows the return loss measurement for the multi-band PIFA of the present invention. The return loss are −6.30 dB, −9.03 dB, −5.67 dB, −5.16 dB, −8.41 dB and −5.62 dB for operational frequencies of 824 MHz, 894 MHz, 960 MHz, 1710 MHz, 1990 MH and 2170 MHz, respectively. As can be seen from this figure, all the return loss of the multi-band PIFA of the present invention at frequencies of interest are below −5.0. This proves the multi-band PIFA of the present invention has excellent return loss for multiple frequencies.

Figure 7:
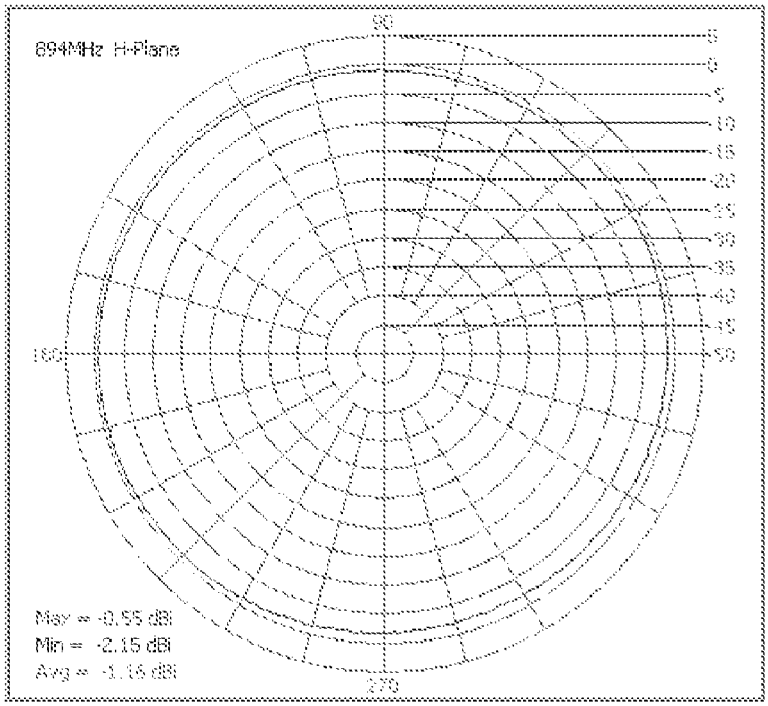
FIG. 7 shows the H-plane antennae gain of the multi-band PIFA of the present invention at 894 Hz.
Figure 8:
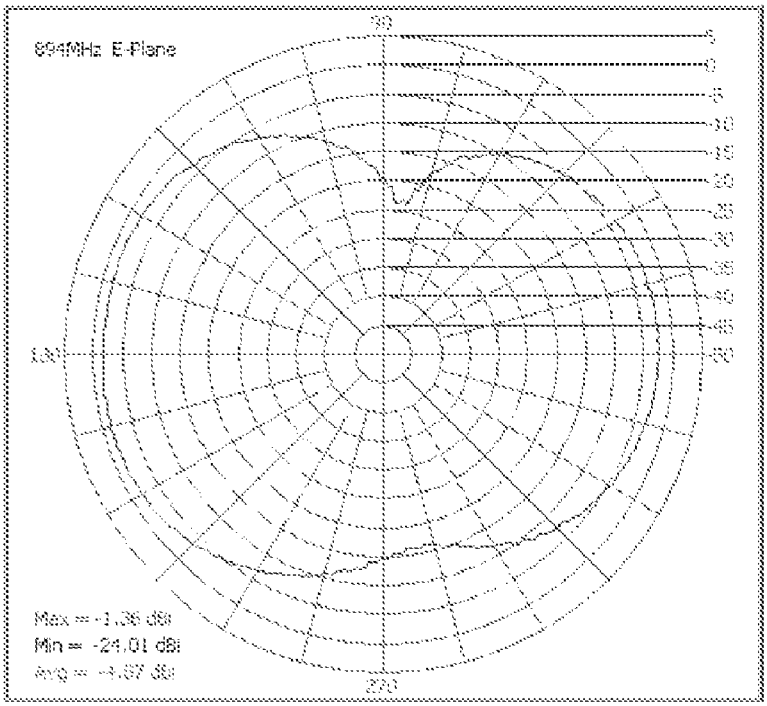
FIG. 8 shows the E-plane antennae gain of the multi-band PIFA of the present invention at 894 Hz.
Figure 9:
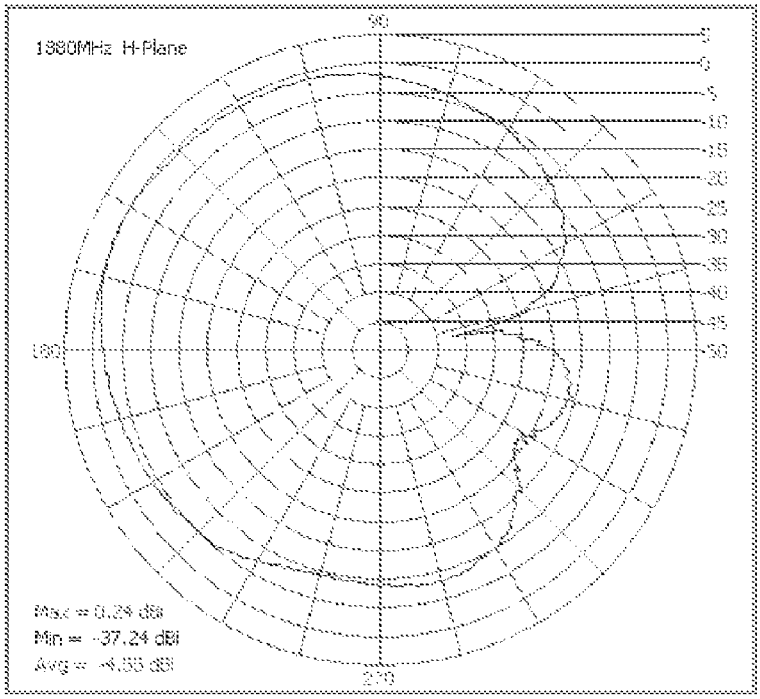
FIG. 9 shows the H-plane antennae gain of the multi-band PIFA of the present invention at 1880 Hz.
Figure 10:
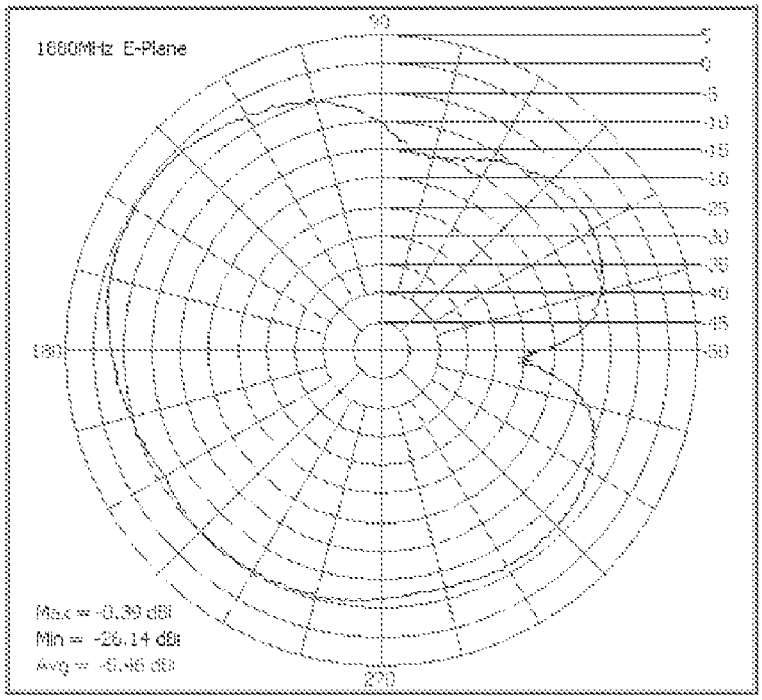
FIG. 10 shows the E-plane antennae gain of the multi-band PIFA of the present invention at 1880 Hz.

FIGS. 7 to 10 show the antenna gains of the present invention on different polarized principle planes and at different frequencies. As shown in FIG. 7, the peak gain on vertically polarized principle plane is −0.55 dBi when the antenna of the present invention is operated at 894 MHz. As shown in FIG. 8, the peak gain on horizontally polarized principle plane is −1.36 dBi when the antenna of the present invention is operated at 894 MHz. As shown in FIG. 9, the peak gain on vertically polarized principle plane is 0.24 dBi when the antenna of the present invention is operated at 1880 MHz. As shown in FIG. 10, the peak gain on horizontally polarized principle plane is −0.39 dBi when the antenna of the present invention is operated at 1880 MHz.

Figure 11:
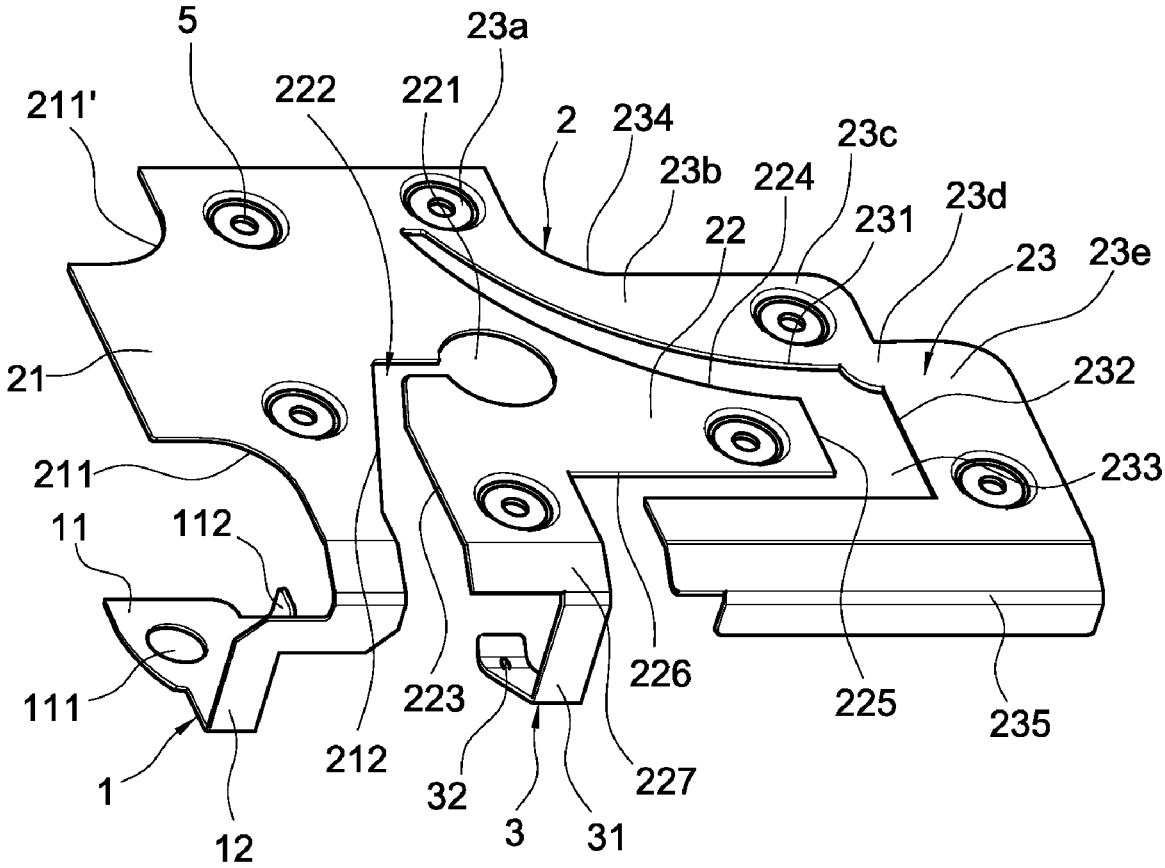
FIG. 11 shows the perspective view of the multi-band planar inverted-F antenna according to another preferred embodiment of the present invention.

FIG. 11 shows the perspective view of the multi-band planar inverted-F antenna according to another preferred embodiment of the present invention. As shown in this figure, a plurality of round grooves 5 are defined on the surface of the radiating unit 2. The round grooves 5 enhance stress on the radiating unit 2 to prevent a deformation of the radiating unit 2.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A multi-band planar inverted-F antenna, comprising:

a radiating unit comprising a common radiating element, a high-frequency (HF) radiating element and a low-frequency (LF) radiating element, a quasi U-shaped slot defined between the HF radiating element and the LF radiating element, a round through hole defined at a junction between the HF radiating element and the common radiating element, an L-shaped slot communicated with the round through hole;

a ground unit electrically connected to one side of the radiating unit; and a feeding unit comprising a strip electrically connected to one side of the HF radiating element;

wherein the ground unit comprises a ground point and an inverted-L short-line, one end of the inverted-L short-line is connected to the ground point and another end of the inverted-L short-line is connected to the common radiating element such that the inverted-L short-line is electrically connected between the ground point and the feeding unit.

2. The multi-band planar inverted-F antenna as in claim 1, wherein the length of the inverted-L short-line is ⅛ wavelength of a resonant mode of the antenna.

3. The multi-band planar inverted-F antenna as in claim 1, wherein the ground unit is of strip shape.

4. The multi-band planar inverted-F antenna as in claim 1, wherein a ground hole is defined at the ground point and a flange is extended from the ground point.

5. The multi-band planar inverted-F antenna as in claim 1, wherein the radiating unit is of plate shape.

6. The multi-band planar inverted-F antenna as in claim 1, wherein two dents are defined on one side of the radiating unit.

7. The multi-band planar inverted-F antenna as in claim 1, wherein the ground unit and the radiating is connected at a bending angle of about 90 degree.

8. The multi-band planar inverted-F antenna as in claim 1, wherein the L-shaped slot is defined by a bottom side of the HF radiating element and a top side of the common radiating element, and is communicated with the round through hole of the HF radiating element.

9. The multi-band planar inverted-F antenna as in claim 1, wherein the area of the HF radiating element is defined by an arc-shaped lateral side, a parallel top side and an L-shaped lateral side.

10. The multi-band planar inverted-F antenna as in claim 9, wherein a tab is extended from the L-shaped lateral side.

11. The multi-band planar inverted-F antenna as in claim 1, wherein the LF radiating element comprises an arc-shaped inner side and an L-shaped inner side, wherein the quasi U-shaped slot is defined by the arc-shaped inner side and the L-shaped inner side as well as an arc-shaped lateral side, a parallel top side and an L-shaped lateral side.

12. The multi-band planar inverted-F antenna as in claim 1, wherein the area of the LF radiating element is defined by a stair-shaped section, an arc-shaped inner side and an L-shaped inner side.

13. The multi-band planar inverted-F antenna as in claim 12, wherein the area of the LF radiating element comprises a first surface portion, a second surface portion, a third surface portion, a fourth surface portion and a fifth surface portion, wherein the second surface portion and the fourth surface portion have relatively narrower width than those of the first surface portion, the third surface portion and the fifth surface portion.

14. The multi-band planar inverted-F antenna as in claim 1, further comprising a bent panel with continuous bending and extended from one side of the LF radiating element.

15. The multi-band planar inverted-F antenna as in claim 1, wherein the feeding element is electrically connected to the HF radiating element at a bending angle of about 90 degrees.

16. The multi-band planar inverted-F antenna as in claim 1, wherein the strip is of L shape and connected to a tab on one side of the HF radiating element, the strip comprises a through hole thereon.

17. The multi-band planar inverted-F antenna as in claim 16, further comprising a coaxial cable soldered to the through hole on the strip.

* * * * *